US008971772B2

(12) United States Patent
Senda et al.

(10) Patent No.: US 8,971,772 B2
(45) Date of Patent: Mar. 3, 2015

(54) DEVELOPER TRANSPORT MEMBER AND DEVELOPING APPARATUS

(71) Applicants: Seiichi Senda, Anjo (JP); Shuichi Kato, Nagoya (JP); Hiroshi Igarashi, Nagoya (JP)

(72) Inventors: Seiichi Senda, Anjo (JP); Shuichi Kato, Nagoya (JP); Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 36 days.

(21) Appl. No.: 13/852,298

(22) Filed: Mar. 28, 2013

(65) Prior Publication Data

US 2013/0322928 A1 Dec. 5, 2013

(30) Foreign Application Priority Data

May 30, 2012 (JP) ..... 2012-122763

(51) Int. Cl.
*G03G 15/08* (2006.01)

(52) U.S. Cl.
CPC ..... *G03G 15/0832* (2013.01); *G03G 15/0889* (2013.01)
USPC ..... 399/262; 399/258; 399/263

(58) Field of Classification Search
USPC ..... 399/258, 262, 263
See application file for complete search history.

(56) References Cited

U.S. PATENT DOCUMENTS 5,539,502 A * 7/1996 Koshino et al. ..... 399/272
5,548,386 A * 8/1996 Fukuda ..... 399/284
5,875,378 A * 2/1999 Campbell et al. ..... 399/263
5,884,130 A * 3/1999 Tsutsumi et al. ..... 399/254
6,049,685 A * 4/2000 Murakami et al. ..... 399/263
6,128,453 A * 10/2000 Ban et al. ..... 399/106
6,266,505 B1 * 7/2001 Ban et al. ..... 399/258
6,337,964 B2 1/2002 Inami et al.
6,347,207 B1 * 2/2002 Ishiguro et al. ..... 399/258
6,385,422 B1 * 5/2002 Ishiguro et al. ..... 399/258
6,421,517 B1 * 7/2002 Nishino et al. ..... 399/254
6,907,215 B2 * 6/2005 Yasukawa et al. ..... 399/281
7,184,693 B2 * 2/2007 Choi et al. ..... 399/281
7,860,437 B2 12/2010 Kakuta et al.
7,899,367 B2 * 3/2011 Fukuta ..... 399/254
7,933,539 B2 * 4/2011 Kubota et al. ..... 399/258
2001/0036375 A1 11/2001 Inami et al.
2001/0038762 A1 * 11/2001 Ban et al. ..... 399/258
2002/0025183 A1 * 2/2002 Murakami et al. ..... 399/109
2002/0127023 A1 * 9/2002 Nozawa ..... 399/27
2002/0127032 A1 * 9/2002 Ban et al. ..... 399/262
2005/0002698 A1 * 1/2005 Jeon ..... 399/254
2006/0034644 A1 * 2/2006 Ishii ..... 399/263
2006/0188278 A1 * 8/2006 Abe et al. ..... 399/57
2006/0198643 A1 * 9/2006 Kimura et al. ..... 399/27
2006/0222414 A1 * 10/2006 Yamamura ..... 399/263
2007/0041749 A1 * 2/2007 Kern et al. ..... 399/263
2008/0095553 A1 * 4/2008 Tanaka et al. ..... 399/263
2008/0145112 A1 * 6/2008 Bessette ..... 399/263
2008/0247784 A1 10/2008 Kakuta et al.

(Continued)

FOREIGN PATENT DOCUMENTS

JP 2000-231249 A 8/2000
JP 2008-170951 A 7/2008

*Primary Examiner* — David Bolduc
(74) *Attorney, Agent, or Firm* — Banner & Witcoff, Ltd.

(57) ABSTRACT

There is provided a developer transport member including a rotatable member, a main body configured to transport the developer by being rotated in accordance with rotation of the rotatable member, and a metal spring configured to bias the main body.

9 Claims, 8 Drawing Sheets

(56) References Cited

U.S. PATENT DOCUMENTS

| | | | | |
|---|---|---|---|---|
| 2008/0292331 | A1* | 11/2008 | Yokomori et al. | 399/27 |
| 2009/0022507 | A1* | 1/2009 | Abe et al. | 399/30 |
| 2009/0220285 | A1* | 9/2009 | Kimura et al. | 399/263 |
| 2010/0232815 | A1* | 9/2010 | Zheng | 399/27 |
| 2010/0247117 | A1* | 9/2010 | Tomatsu | 399/21 |
| 2011/0076062 | A1 | 3/2011 | Kakuta et al. | |
| 2011/0222871 | A1* | 9/2011 | Suzuki et al. | 399/27 |
| 2012/0170955 | A1 | 7/2012 | Kakuta et al. | |

* cited by examiner

DEVELOPER TRANSPORT MEMBER AND DEVELOPING APPARATUS

CROSS REFERENCE TO RELATED APPLICATION

The present application claims priority from Japanese Patent Application No. 2012-122763, filed on May 30, 2012, the disclosure of which is incorporated herein by reference in its entirety.

BACKGROUND OF THE INVENTION

1. Field of the Invention

The present invention relates to a developer transport member configured to transport a developer, and a developing apparatus provided with the developer transport member.

2. Description of the Related Art

In general, a developing apparatus of an image forming apparatus such as a laser printer or the like includes a developing chamber having a supply roller and a developing roller for carrying a developer, and a developer accommodating chamber in which the developer is accommodated. In the developing apparatus of the known image forming apparatus, the developer accommodated in the developer accommodating chamber is principally transported to the developing chamber by means of a developer transport member which is provided in the developer accommodating chamber.

The developer transport member principally includes a rotational shaft, and a main developer transport member body having a proximal end portion fixed to the rotational shaft and configured to be rotatable together with the rotational shaft. The main developer transport member body has the forward end portion which makes sliding contact with the inner surface of the developer accommodating chamber to cause the deflective deformation (flexible deformation). The developer is released toward the developing chamber by utilizing the elastic force brought about by the restoration from the state of deflective deformation. The main developer transport member body as described above is formed of a sheet-shaped member made of resin.

SUMMARY OF THE INVENTION

However, when the main developer transport member body stops in a state of making a contact with the inner surface of the developer accommodating chamber, and the main developer transport member body is left to stand as it is while maintaining this state for a long period of time, then the main developer transport member body causes the creep deformation, and the elastic force is weakened. As a result, the transport ability of the developer transport member is lowered or deteriorated, and it becomes impossible to supply a sufficient amount of the developer to the developing chamber. In particular, in the case of such an arrangement that the developing chamber is arranged over or above the developer accommodating chamber, if the elastic force of the main developer transport member body is weakened, a problem arises such that the transport amount of the developer is greatly decreased.

In view of the above, an object of the present invention is to provide a developer transport member which makes it possible to suppress the decrease in the transport ability of the developer transport member and supply a sufficient amount of a developer.

According to a first aspect of the present teaching, there is provided a developer transport member including:

a rotatable member;

a main body configured to transport the developer by being rotated in accordance with rotation of the rotatable member; and a metal spring configured to bias the main body.

According to a second aspect of the present teaching, there is provided a developing apparatus including:

a developer carrier configured to carry developer;

a casing defining a developer accommodating chamber for accommodating the developer and a developing chamber in which the developer carrier is arranged, a developer transport member configured to transport the developer from the developer accommodating chamber to the developing chamber, the developing transport member including:

a rotatable member;

a main body configured to transport the developer by being rotated in accordance with rotation of the rotatable member; and a metal spring configured to bias the main body in a direction directed from an upstream side to a downstream side in a rotating direction when the main body is rotated while making a contact with an inner surface of the developer accommodating chamber In any case, the metal member hardly causes the creep deformation. Therefore, even when the metal member is left to stand as it is for a long period of time in a state of being deflected or flexibly bent in the developer accommodating chamber during the stop of the developer transport member, it is possible to suppress the decrease in the transport ability of the developer transport member. Therefore, it is possible to stably supply a sufficient amount of the developer to the outside of the developer accommodating chamber.

DESCRIPTION OF THE PREFERRED EMBODIMENTS

First Embodiment

Next, an embodiment of the developer transport member of the present teaching will be explained in detail appropriately with reference to the drawings. In the following description, a schematic arrangement of a laser printer 1 provided with a developing apparatus according to one embodiment will be firstly explained, and then the construction concerning the feature of the present teaching will be explained. In the following description, the directions will be explained by using the directions provided on the basis of a user who uses the laser printer 1. That is, as viewed in FIG. 1, the right side is defined as "front", and the left side is defined as "rear". The forward side is defined as "left", and the backward side is defined as "right". Further, the upward-downward direction, which is provided in FIG. 1, is defined as "up-down".

[Schematic Arrangement of Laser Printer]

Figure 1:
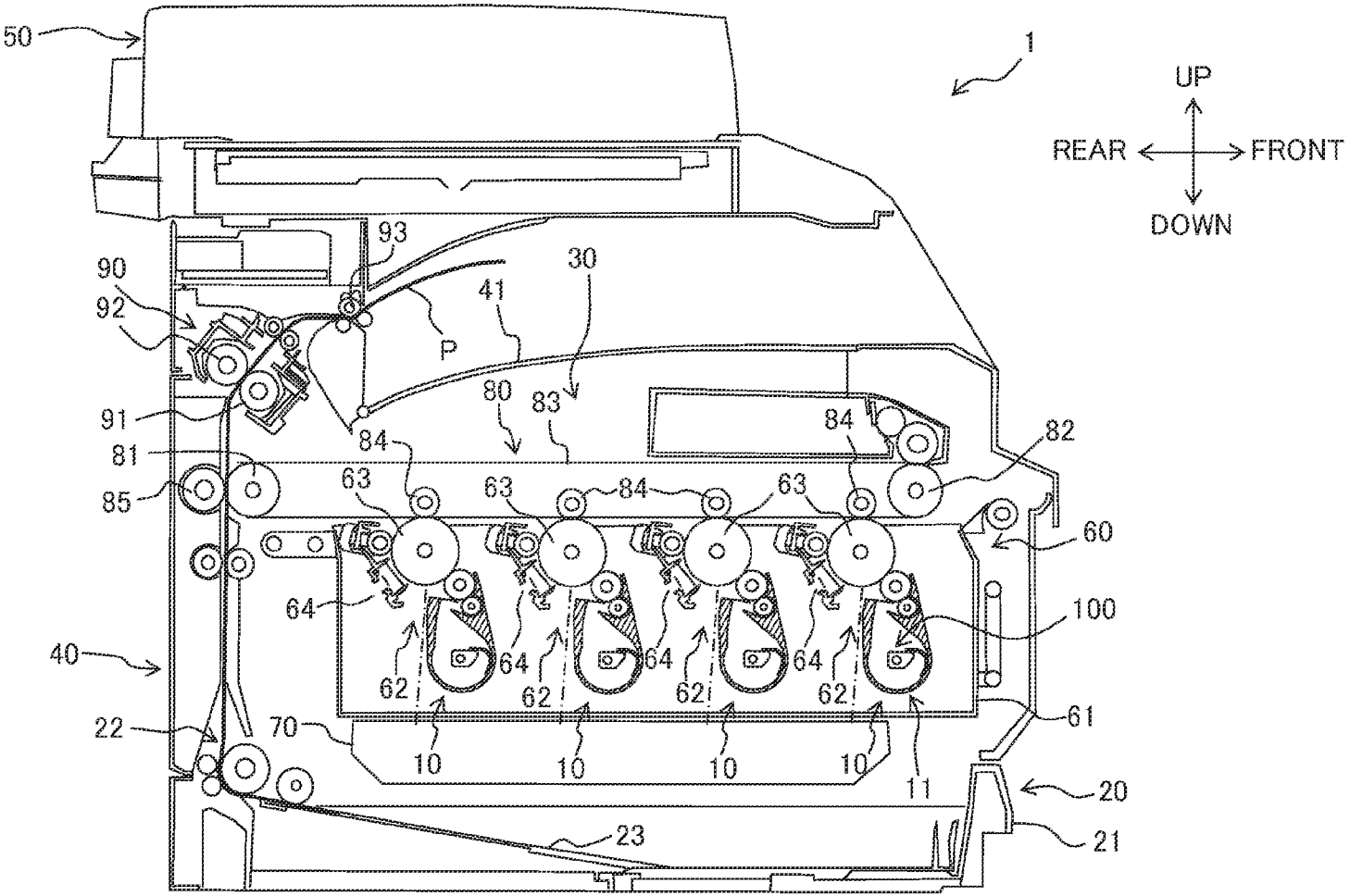
FIG. 1 shows a sectional view illustrating a laser printer provided with an agitator according to a first embodiment.

As shown in FIG. 1, the laser printer 1 includes, for example, in a main body casing 40, a paper feed unit 20 configured to feed the printing paper P, and an image forming unit 30 configured to form an image on the printing paper P. Further, the laser printer 1 includes, on the main body casing 40, a flat bed scanner 50 configured to read or scan a manuscript to generate image data. In this arrangement, the image forming unit 30 includes, for example, a process unit 60, an exposure unit 70, a transfer unit 80, and a fixing unit 90.

The paper feed unit 20 includes a paper feed tray 21 arranged under or below the main body casing 40, a paper feed mechanism 22 arranged on the rear side of the paper feed tray 21, and a printing paper pressing plate 23 configured to upwardly push or press the printing paper P accommodated in the paper feed tray 21. The printing paper P, which is accommodated in the paper feed tray 21, is drawn upwardly by the printing paper pressing plate 23. The printing paper P is separated one by one by the paper feed mechanism 22, and the printing paper P is transported upwardly.

The process unit 60 includes four process cartridges 62 which are accommodated in a holding case 61 and which are arranged at predetermined intervals in the front-back direction. Each of the process cartridges 62 includes a photosensitive drum 63 which has a photosensitive layer formed on the surface, an electrifier (charger) 64 configured to uniformly electrify the photosensitive layer of the photosensitive drum 63, and a developing cartridge 10 as an example of the developing apparatus for supplying the developer to the photosensitive layer of the photosensitive drum 63. The photosensitive drum 63 is arranged at an upper portion of the process cartridge 62, the electrifier 64 is arranged on the rear side of the photosensitive drum 63, and the developing cartridge 10 is arranged under or below the photosensitive drum 63.

In each of the process cartridges 62, the photosensitive layer, which is disposed on the surface of the photosensitive drum 63, is uniformly electrified or charged by the electrifier 64, followed by being scanned at a high speed with a laser beam radiated from the exposure unit 70 so that the photosensitive layer is exposed. As a result of the exposure of the photosensitive layer, an electrostatic latent image, which is based on the image data, is formed on the surface of the photosensitive drum 63. A toner, which is an example of the developer, is supplied from the developing cartridge 10 to the electrostatic latent image formed on the surface of the photosensitive drum 63. Thus, a toner image, in which the electrostatic latent image is visualized, is formed on the surface of the photosensitive drum 63.

The exposure unit 70 is arranged under or below the process unit 60, and over or above the paper feed unit 20. The exposure unit 70 includes, for example, a laser light source (not shown), polygon mirrors, lenses, and reflecting mirrors. As for the exposure unit 70, the laser beam, which is radiated from the laser light source, is reflected by the polygon mirror and the reflecting mirror, and the laser beam is radiated onto the surface of the photosensitive drum 63. The laser beam is subjected to the scanning at a high speed, and thus the surface of the photosensitive drum 63 is exposed.

The transfer unit 80 is arranged over or above the process unit 60. The transfer unit 80 includes a driving roller 81 arranged over or above the paper feed mechanism 22 on the rear side in the main body casing 40, a driven roller 82 arranged on the front side in the main body casing 40, and an intermediate transfer belt 83 configured to be wound between the driving roller 81 and the driven roller 82.

The transfer unit 80 includes four primary transfer rollers 84 arranged on the inner side of a lower side pass line of the intermediate transfer belt 83 opposingly to the respective photosensitive drums 63 so that the intermediate transfer belt 83 is pressed against the four photosensitive drums 63 of the four process cartridges 62, and a secondary transfer roller 85 arranged opposingly to the driving roller 81 so that the printing paper P is pressed against the intermediate transfer belt 83.

In the transfer unit 80, the toner images of the respective colors, which are formed on the photosensitive layers of the surfaces of the respective four photosensitive drums 63, are successively overlaid and transferred onto the intermediate transfer belt 83. Further, the printing paper P, which is transported upwardly from the paper feed mechanism 22, is pressed against the intermediate transfer belt 83 by means of the secondary transfer roller 85. Accordingly, the toner images of the respective colors, which have been overlaid and transferred onto the intermediate transfer belt, are transferred to the printing paper P.

The fixing unit 90 is arranged over or above the driving roller 81 of the transfer unit 80. The fixing unit 90 includes a heating roller 91 configured to heat the printing paper P transported upwardly while being pressed by the secondary transfer roller 85, and a pressing roller 92 arranged opposingly to the heating roller 91 so that the printing paper P is pressed against the heating roller 91. In the fixing unit 90, the toner images of the respective colors, which have been transferred to the printing paper P from the intermediate transfer belt 83, are thermally fixed by being heated by the heating roller 91. The printing paper P, on which the toner images of the respective colors have been thermally fixed, is discharged onto the paper discharge tray 41 by means of a paper discharge roller 93.

[Detailed Arrangement of Developing Cartridge]

Next, an explanation will be made about the detailed arrangement of the developing cartridge 10.

Figure 2:
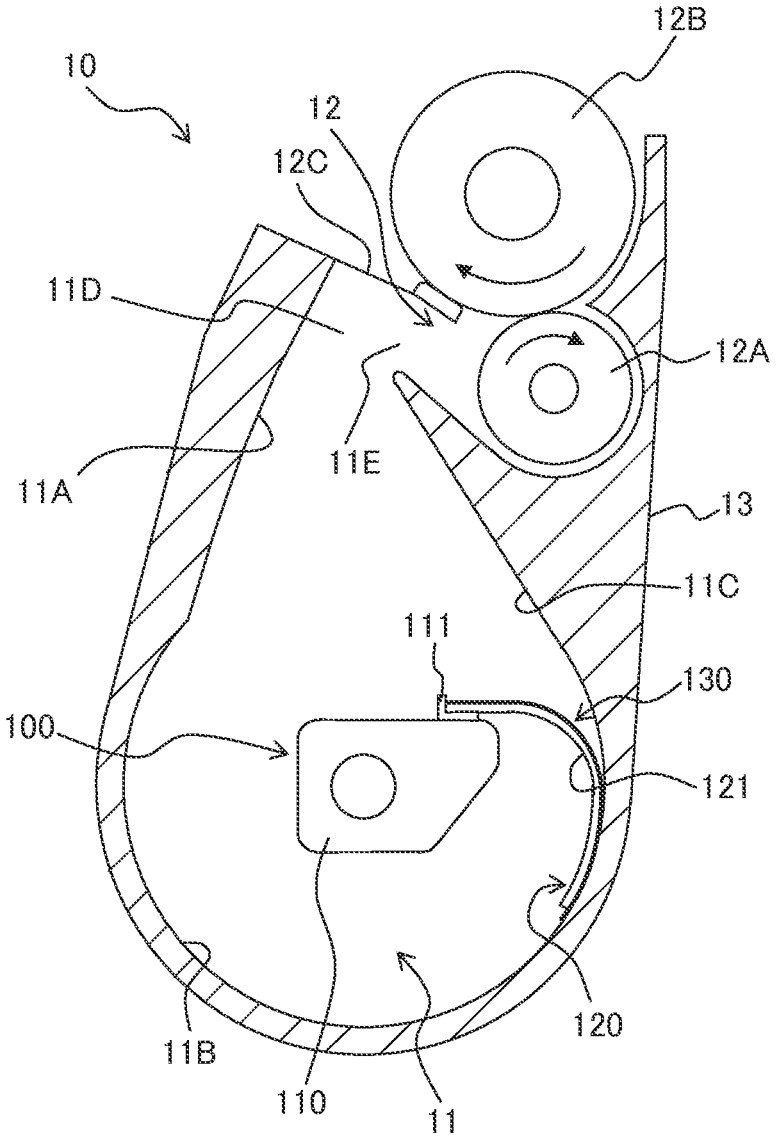
FIG. 2 shows an enlarged view illustrating a developing cartridge.

As shown in FIG. 2 while being enlarged, the casing 13 of the developing cartridge 10 is formed with the developer accommodating chamber 11 in which the unillustrated toner is accommodated, and the developing chamber 12 arranged over or above the developer accommodating chamber 11. An agitator 100, which is an example of the developer transport member, is provided in the developer accommodating chamber 11.

[Arrangement of Developer Accommodating Chamber]

An opening is formed at an upper portion of the developer accommodating chamber 11. A lateral cross-sectional shape thereof is formed to be raindrop-shaped as shown in FIG. 2. A collision portion 11A is formed at an upper portion on the rear side (left side) of the inner wall for defining the developer accommodating chamber 11, a sliding flat surface portion 11C is formed at an upper portion on the front side (right side) of the inner wall, and a sliding curved surface portion 11B, which is continued to the collision portion 11A and the sliding flat surface portion 11C, is formed at a lower portion of the inner wall. A developer transport portion 11D is constructed in the space between the sliding flat surface portion 11C and the collision portion 11A. A developer feeding port 11E is open at an upper portion of the developer transport portion 11D.

The collision portion 11A is the wall surface against which a main agitator body 130 (main developer transport member body) of the agitator 100 is allowed to collide in the rotating direction as described later on.

The sliding curved surface portion 11B is the curved surface-shaped wall surface along which the main agitator body 130 is allowed to slide while being elastically brought in contact therewith in such a state that the main agitator body 130 is elastically deformed toward the upstream side (back side in the direction of movement) in the rotating direction.

The sliding flat surface portion 11C is the flat surface-shaped wall surface along which the forward end portion of the main agitator body 130 is allowed to slide while being elastically brought in contact therewith in such a state that the main agitator body 130 is elastically deformed toward the upstream side in the rotating direction. The sliding flat surface portion 11C is inclined so that the upper portion approaches the collision portion 11A.

The developer transport portion 11D is such a space that the main agitator body 130, which is elastically deformed toward the upstream side in the rotating direction, is rotated toward the collision portion 11A while being elastically restored to the free state.

The developer feeding port 11E is the feeding port for feeding the toner from the developer transport portion 11D toward the developing chamber 12. The developer feeding port 11E is open over or above the sliding flat surface portion 11C on the upstream side in the rotating direction of the main agitator body 130 from the collision portion 11A.

[Arrangement of Developing Chamber]

The developing chamber 12 is arranged with a supply roller 12A, a developing roller 12B as an example of the developer carrier, and a layer thickness regulating blade 12C. The developing chamber 12 is communicated with the developer accommodating chamber 11 at the developer feeding port 11E.

The supply roller 12A is the member which is provided in order that the toner adhered to the circumferential surface of the supply roller 12A is supplied to the circumferential surface of the developing roller 12B. The supply roller 12A is arranged under or below the developing roller 12B. The rotating directions of the supply roller 12A and the developing roller 12B are clockwise in the example shown in FIG. 2. On the circumferential surfaces on which the both are opposed to one another, the supply roller 12A is moved forwardly (rightwardly), and the developing roller 12B is moved backwardly (leftwardly) oppositely thereto. Accordingly, the toner is smoothly supplied from the circumferential surface of the supply roller 12A to the circumferential surface of the developing roller 12B.

The developing roller 12B is the member which allows the toner supplied from the supply roller 12A to be carried on the circumferential surface so that the toner is supplied to the electrostatic latent image formed on the circumferential surface of the photosensitive drum 63 (see FIG. 1). The developing roller 12B is arranged at the position deviated toward the front under or below the photosensitive drum 63.

The layer thickness regulating blade 12C is the member which constantly regulates the layer thickness of the toner to be carried after being supplied from the circumferential surface of the supply roller 12A to the circumferential surface of the developing roller 12B. The layer thickness regulating blade 12C has the proximal end portion which is fixed to the upper portion of the backward (left) portion of the developer accommodating chamber 11 formed with the collision portion 11A. The layer thickness regulating blade 12C makes a contact with the lower side circumferential surface of the developing roller 12B rotating in the backward direction (leftward direction) so that the forward end portion, which protrudes in the forward direction (rightward direction) from the proximal end portion, is opposed in the rotating direction of the developing roller 12B.

[Arrangement of Agitator]

The agitator 100 is the part which is rotatable so that the unillustrated toner accommodated in the developer accommodating chamber 11 is agitated and transported to the developer feeding port 11E. The agitator 100 has a rotatable member 110 extending in the left-right direction in the developer accommodating chamber 11, a plate spring 120 as an example of the metal member, and the main agitator body 130, proximal end portions of the plate spring 120 and the main agitator body 130 being fixed to a base portion 111 of the rotatable member 110 respectively.

Figure 3A:
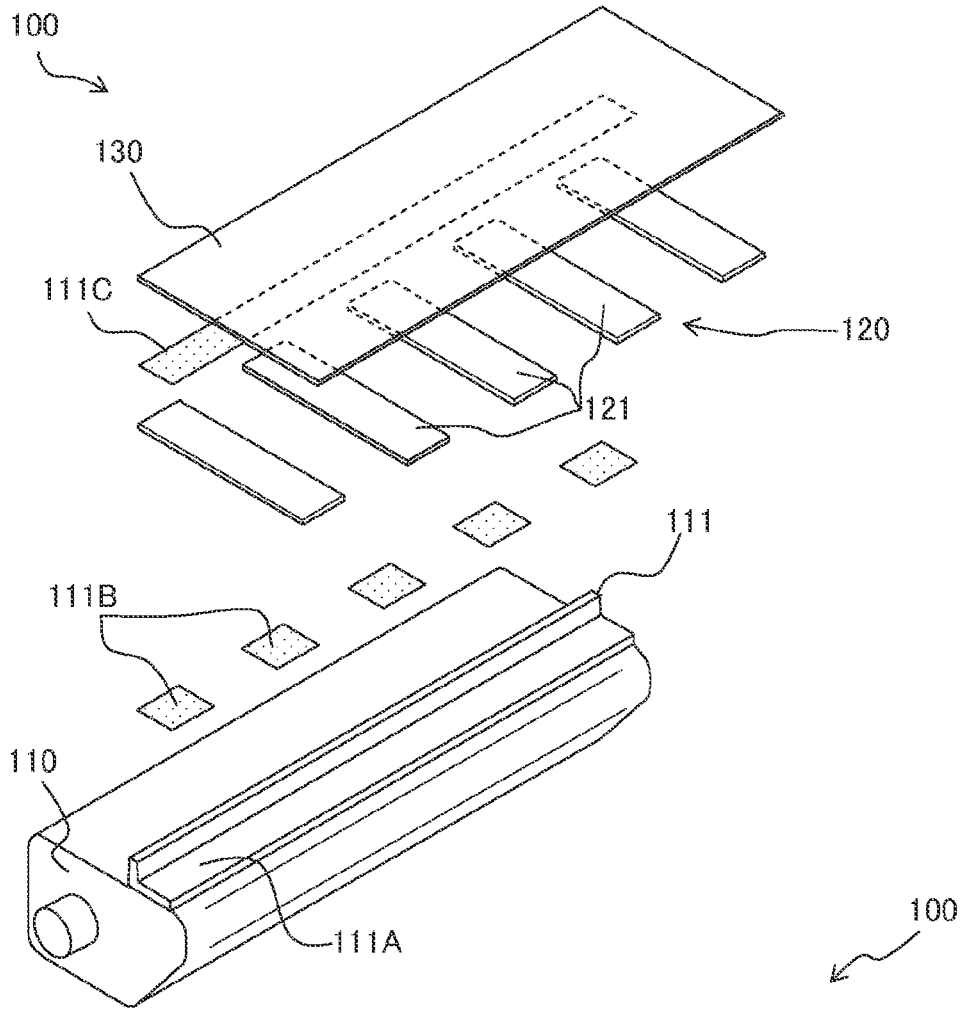
FIG. 3A shows an exploded perspective view illustrating the agitator according to the first embodiment.
Figure 3B:
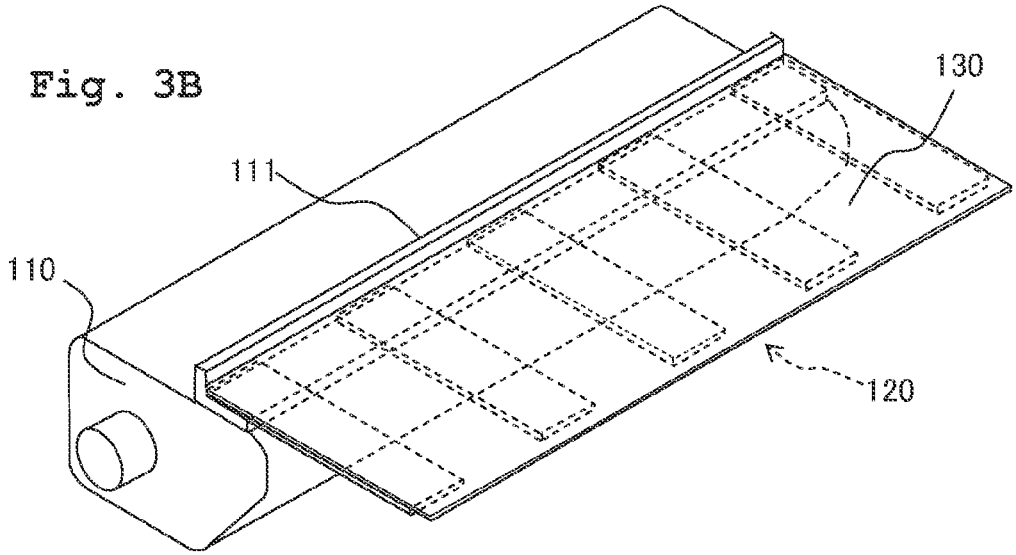
FIG. 3B shows a perspective view illustrating an assembled state.

As shown in FIGS. 3A and 3B, the base portion 111 has an L-shaped form as viewed in a sectional view, and the base portion 111 is formed to extend in the left-right direction of the rotatable member 110. The base portion 111 has a fixing surface 111A which is disposed on the downstream side in the rotating direction and to which the proximal end portions of the plate spring 120 and the main agitator body 130 are fixed.

The plate spring 120 is formed as a plurality of plate-shaped metal pieces which are elastically deformable, and the plate spring 120 has biasing portions 121 which pushes or biases the main agitator body 130. The proximal end portions of the plate spring 120 are fixed by pieces of double sided tape 111B to the fixing surface 111A of the base portion 111. The length of the plate spring 120 ranging from the proximal end to the forward end (distal end) is set to such a length that the forward end portion of the plate spring 120 is positioned on the side of the base portion 111 (side of the rotatable member 110) as compared with the forward end portion of the main agitator body 130. The forward end portions of the both are not secured to one another. That is, the forward end portion of the plate spring 120 and the forward end portion of the main agitator body 130 can be deviated from each other in the in-plane direction (surface direction) thereof.

The main agitator body 130 is formed as a sheet-shaped member which is formed of a resin such as polyethylene terephthalate or the like and which is capable of performing deflective deformation. The proximal end portion thereof is fixed by double sided tape 111C to the fixing surface 111A of the base portion 111 and the plate spring 120 fixed to the base portion 111 so that the plate spring 120, which is fixed to the base portion 111, is positioned on the upstream side in the rotating direction of the main agitator body 130. The length of the main agitator body 130, ranging from the proximal end to the forward end, is set to a length to such a degree that the forward end portion arrives at the upper portion of the collision portion 11A confronted with the developer feeding port 11E shown in FIG. 2.

[Detailed Explanation of Toner Transport Operation]

A detailed explanation will now be made with reference to FIGS. 2 and 4 about the operation of the agitator 100.

At first, as shown in FIG. 2, when the main agitator body 130 makes a contact with the inner surface of the developer accommodating chamber 11, especially the sliding curved surface portion 11B, then the plate spring 120, arranged on the upstream side in the rotating direction of the main agitator body 130, is elastically deformed to give such a state that the biasing portions 121 of the plate spring 120 bias the main agitator body 130 in the direction directed from the upstream side to the downstream side in the rotating direction (from the back side to the front side in the direction of movement).

Figure 4:
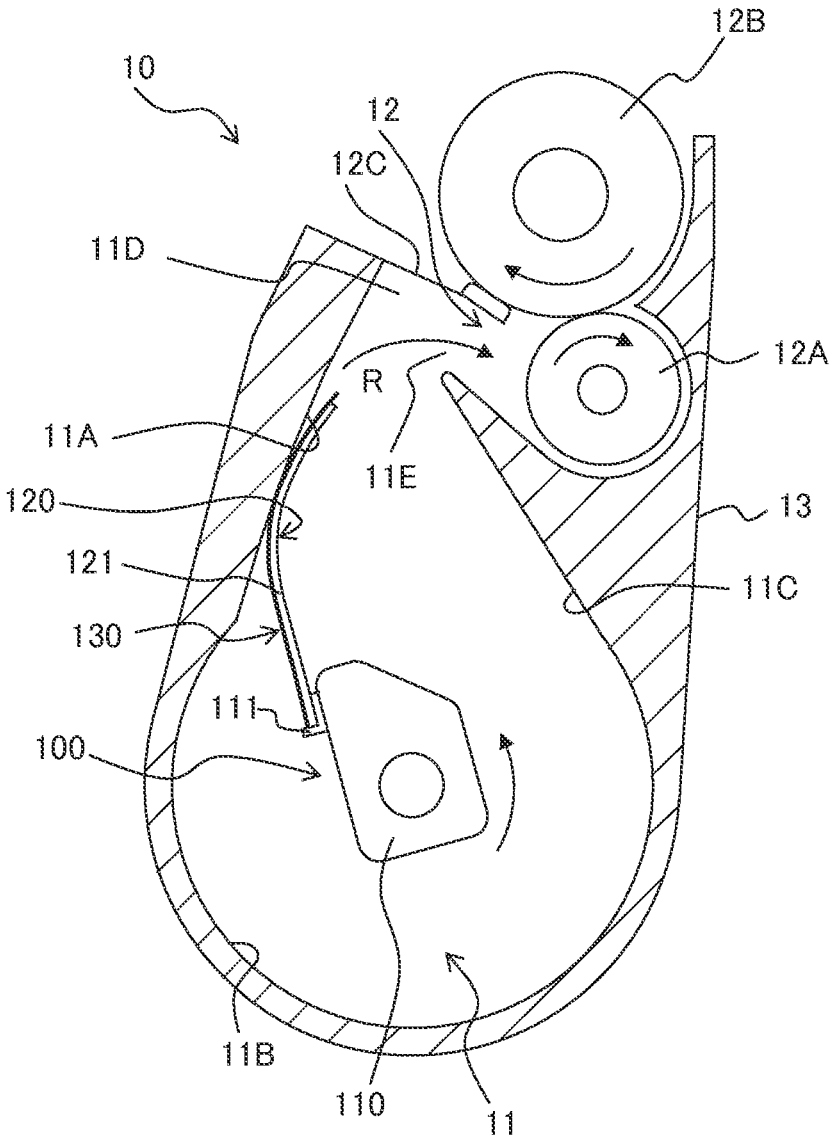
FIG. 4 shows an enlarged view illustrating a developing apparatus to explain the function brought about by the rotation of the agitator.

The main agitator body 130, which is rotated in the direction of the arrow shown in FIG. 4, is in the state of being deflectively deformed toward the upstream side in the rotating direction, and the forward end portion performs the rotation and the sliding movement along the sliding curved surface portion 11B and the sliding flat surface portion 11C of the developer accommodating chamber 11. After that, as shown in FIG. 4, the main agitator body 130 releases the toner to the developer transport portion 11D while being elastically restored to the free state in the flat plate form in the developer transport portion 11D in accordance with the elastic restoring force of the biasing portions 121 of the plate spring 120. The main agitator body 130 is further rotated to collide with the collision portion 11A. Accordingly, the toner transport air flow R is generated. The released toner rides on the transport air flow R, and the toner is transported toward the developer feeding port 11E.

By the way, when the agitator 100 is stopped, then the plate spring 120 and the main agitator body 130 are in the deflected postures in the developer accommodating chamber 11 (see FIG. 2), and the plate spring 120 and the main agitator body 130 are left to stand as they are for a long period of time in some cases. In such a situation, for example, when the structure does not include the plate spring 120, then the main agitator body 130 causes the creep deformation, the elastic restoring force of the main agitator body 130 is weakened, and the transport ability of the agitator 100 is lowered.

However, in the case of the agitator 100 of this embodiment, the toner is released to the developer transport portion 11D by means of the elastic restoring force of the plate spring 120 formed of the metal. In other words, the plate spring 120 hardly causes the creep deformation. Therefore, even when the plate spring 120 is left to stand as it is for a long period of time in the deflected state in the stopped state of the agitator 100, it is possible to suppress the decrease in the transport ability of the agitator 100. Therefore, it is possible to stably supply a sufficient amount of the toner to the developing chamber 12.

The plate spring 120, which hardly causes the creep deformation, supports the main agitator body 130 from the upstream side in the rotating direction of the main agitator body 130. Therefore, even when the rigidity and/or the elastic force of the main agitator body 130 is/are decreased, it is possible to suppress the decrease in the transport ability of the agitator 100. Therefore, even in the case of the structure of the low cost, it is possible to stably supply a sufficient amount of the toner to the developing chamber 12.

The proximal end portions of both of the plate spring 120 and the main agitator body 130 are fixed to the rotatable member 110, and the forward end portions are not secured to one another. Therefore, the forward end portion of the plate spring 120 can be freely deviated with respect to the main agitator body 130, and the plate spring 120 is elastically deformed with ease. Therefore, the elastic restoring force of the agitator 100 is increased, and hence the transport ability of the agitator 100 is improved.

The forward end portion of the plate spring 120 is positioned at the position deviated toward the rotatable member 110 as compared with the forward end portion of the main agitator body 130. Therefore, the plate spring 120 does not make a contact with the inner surface of the developing chamber 12. It is possible to suppress any scratch of the inner surface of the developing chamber 12.

Other embodiments of the present teaching will be successively explained below. In the following respective embodiments, only portions, which are different from those of the first embodiment, will be explained. Portions, which are the same as or equivalent to those of the first embodiment, are designated by the same reference numerals, any explanation of which will be omitted.

Second Embodiment

Figure 5A:
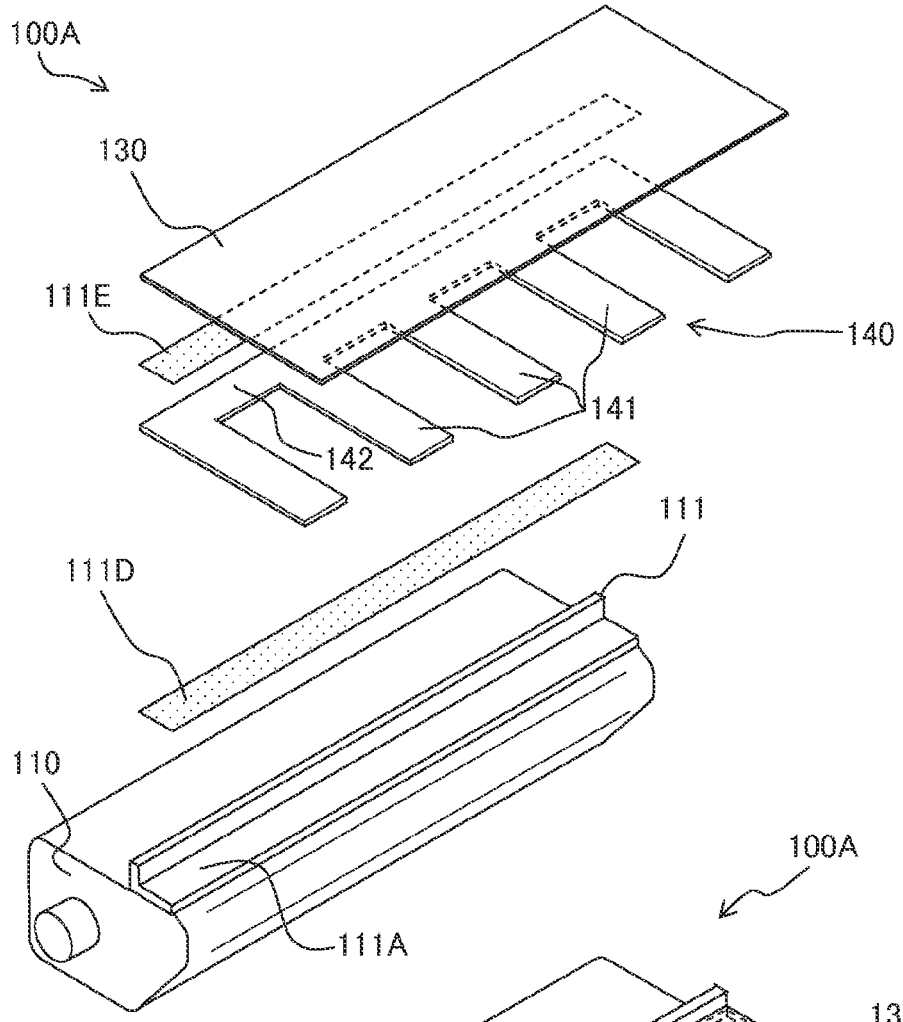
FIG. 5A shows an exploded perspective view illustrating an agitator according to a second embodiment.
Figure 5B:
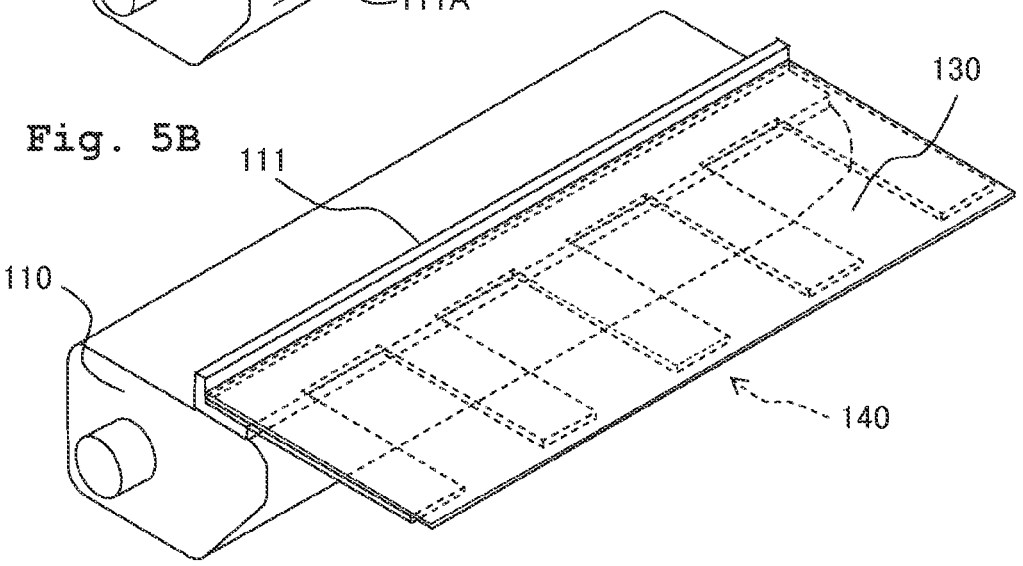
FIG. 5B shows a perspective view illustrating an assembled state.

As shown in FIGS. 5A and 5B, an agitator 100A of a second embodiment uses a plate spring 140 which has a plurality of biasing portions 141 and a connecting portion 142 for connecting proximal end portions of the biasing portions 141 and which is formed to have a comb-shaped form, in place of the plate spring 120 according to the first embodiment. The plate spring 140 has the connecting portion 142 which is fixed by double sided tape 111D to the fixing surface 111A of the base portion 111. Further, the main agitator body 130 is fixed by double sided tape 111E to the connecting portion 142 of the plate spring 140.

According to the agitator 100A, it is possible to stably supply a sufficient amount of the toner to the developing chamber 12 even in the case of the low cost construction, in the same manner as the first embodiment. Further, the metal member can be provided as the integrated part. Therefore, it is easy to assemble the agitator 100A.

Third Embodiment

Figure 6:
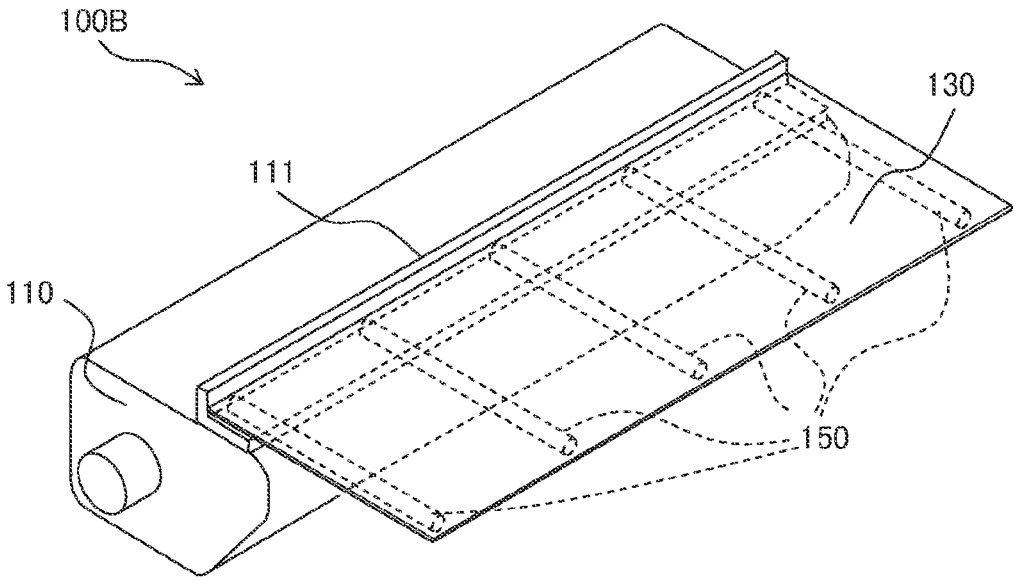
FIG. 6 shows a perspective view illustrating an agitator according to a third embodiment.

As shown in FIG. 6, an agitator 100B of a third embodiment uses a plurality of wire springs 150, in place of the plate spring 120 according to the first embodiment. The wire springs 150 are arranged at the same positions as those concerning the plate spring 120 according to the first embodiment.

According to the agitator 100B, it is possible to stably supply a sufficient amount of the toner to the developing chamber 12 even in the case of the low cost construction, in the same manner as the first embodiment.

Fourth Embodiment

Figure 7:
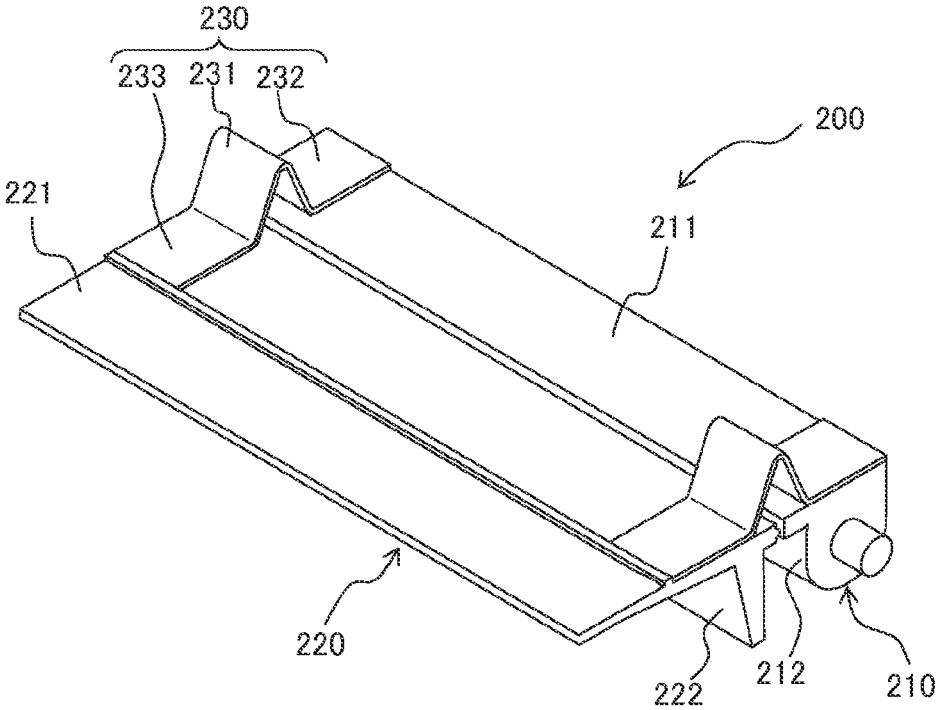
FIG. 7 shows a perspective view illustrating an agitator according to a fourth embodiment.

As shown in FIG. 7, an agitator 200 (developer transport member) of a fourth embodiment is illustrative of another exemplary embodiment, which includes a rotatable member 210, a main agitator body 220 (main developer transport member body), and springs 230 (metal members) for connecting the rotatable member 210 and the main agitator body 220. In the fourth embodiment, the main agitator body 220 includes a member having high rigidity, without using the member capable of performing the deflective deformation.

In this arrangement, the rotatable member 210 is formed to be substantially semi-cylindrical, and the rotatable member 210 has a flat surface portion 211 to which the springs 230 are attached, and a curved surface portion 212 which makes a contact with the main agitator body 220. The main agitator body 220 is a plate-shaped member having a certain thickness. The main agitator body 220 has a transport flat plate portion 221 to which the springs 230 are attached and which is provided to transport the toner, and a displacement regulating portion 222 which is disposed on the side of the proximal end portion of the main agitator body 220 and which is formed to protrude from the surface disposed on the upstream side in the rotating direction.

The spring 230 is an elastically deformable spring such as a plate spring or a wire spring. The spring 230 has a deformable portion 231 which is formed to be substantially V-shaped, and fixing portions 232, 233 which are arranged at both ends of the deformable portion 231. The fixing portion 232, which is disposed on one end side of the both ends of the deformable portion 231, is fixed to the flat surface portion 211 of the rotatable member 210. The surface of the transport flat surface portion 221 of the main agitator body 220, which is disposed on the proximal end portion side from the substantially central position, is fixed to the fixing portion 233 disposed on the other end side.

As shown in FIGS. 8 and 9, for example, the agitator 200 as described above is adopted for a developing cartridge 16 according to another embodiment. A casing 17 of the developing cartridge 16 constitutes a substantially cylindrical developer accommodating chamber 18 and a developing chamber 19 which is arranged on the left side of the developer accommodating chamber 18, and an agitator 200 is provided in the developer accommodating chamber 18. The developer accommodating chamber 18 is communicated with the developing chamber 19 via a supply port 18A which is open at a substantially central portion on the left side as shown in the drawing. A collision portion 18B, against which the forward end portion of the main agitator body 220 collides, is formed at the wall disposed over or above the supply port 18A.

[Detailed Explanation of Toner Transport Operation]

An explanation will now be made in detail about the operation of the agitator 200 with reference to FIGS. 8 and 9.

Figure 8A:
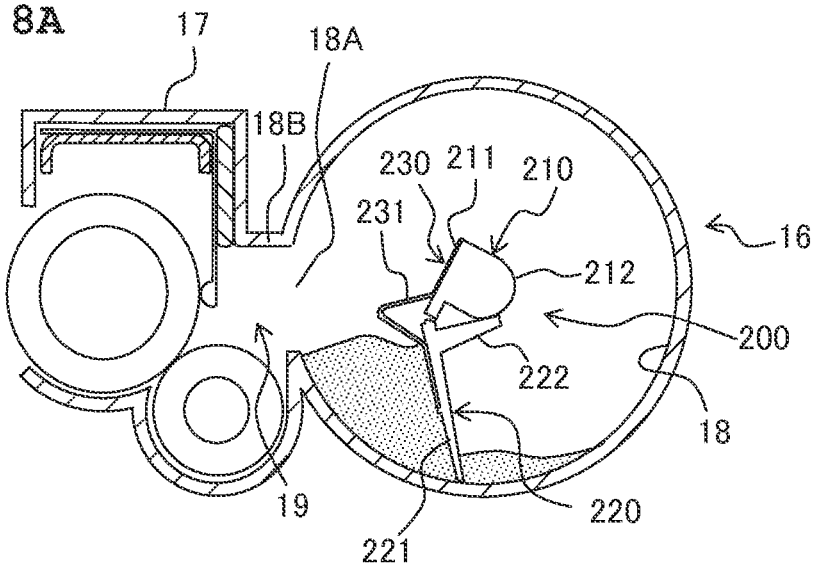
FIGS. 8A, 8B and 8C show the operation of the agitator according to the fourth embodiment.
Figure 8B:
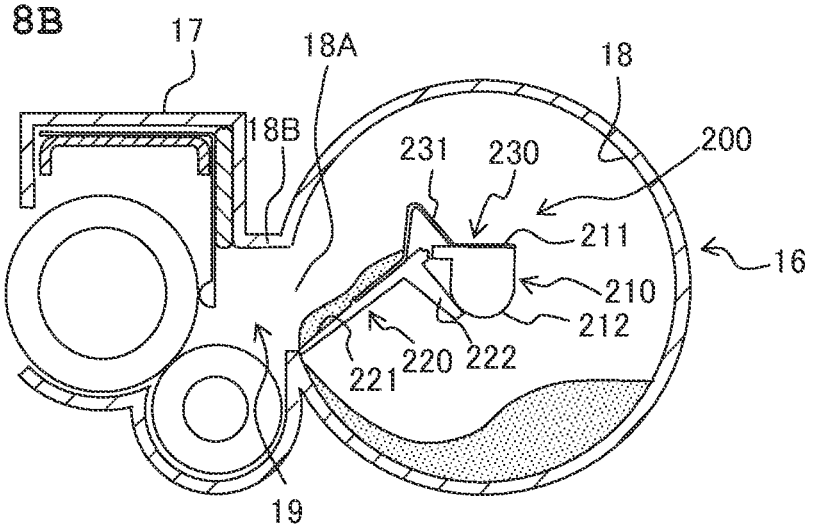
Figure 8C:
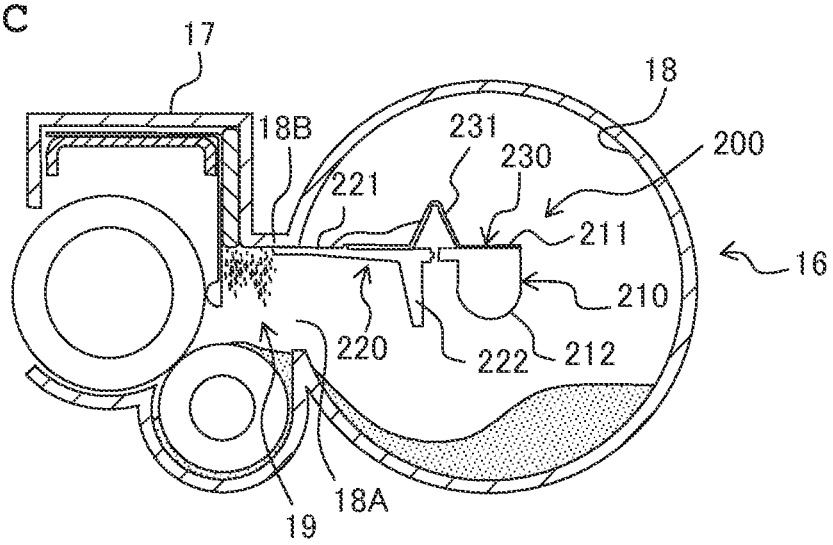

At first, as shown in FIG. 8A, when the forward end portion of the main agitator body 220 makes a contact with the inner surface of the developer accommodating chamber 18, then the deformable portions 231 of the springs 230 are deformed, and thus the agitator 200 is in such a state that the main agitator body 220 is displaced backwardly in the rotating direction as compared with the natural state (see FIG. 8C). In this situation, the displacement regulating portion 222 of the main agitator body 220 makes a contact with the curved surface portion 212 of the rotatable member 210. The agitator 200 is rotated in the developer accommodating chamber 18 while maintaining this state.

When the forward end portion of the main agitator body 220 arrives at the supply port 18A in accordance with the rotation of the agitator 200 (see FIG. 8B), then the forward end portion of the main agitator body 220 is separated from the inner surface of the developer accommodating chamber 18, and the main agitator body 220 is moved while performing the rotation toward the collision portion 18B so that the main agitator body 220 springs up with respect to the rotatable member 210 in accordance with the elastic restoring force of the deformable portions 231 of the springs 230. In this situation, a part of the toner, which is placed on the transport flat surface portion 221 of the main agitator body 220, is supplied from the supply port 18A to the developing chamber 19.

The forward end portion of the main agitator body 220 collides with the collision portion 18B in the rotating direction thereof (see FIG. 8C). Accordingly, the toner, which is placed on the transport flat surface portion 221 of the main agitator body 220, collides with the collision portion 18B, and the toner is supplied as it is so that the toner falls into the developing chamber 19.

Figure 9A:
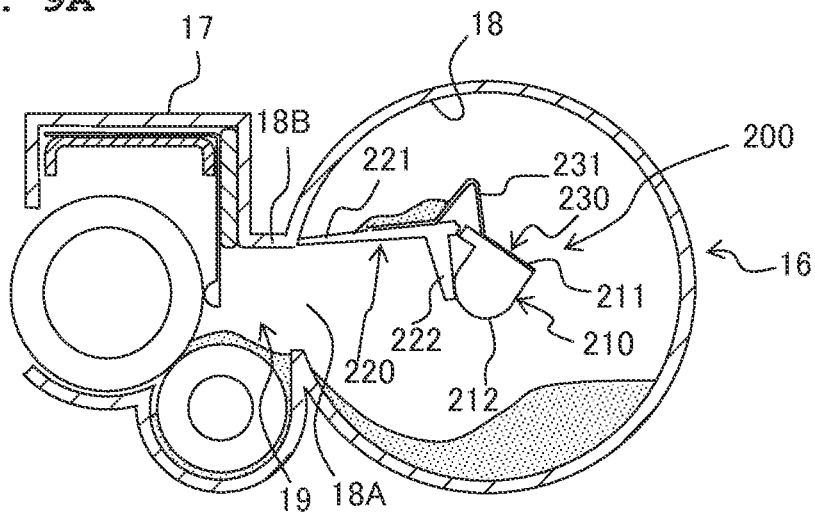
FIGS. 9A and 9B show the operation of the agitator according to the fourth embodiment.
Figure 9B:
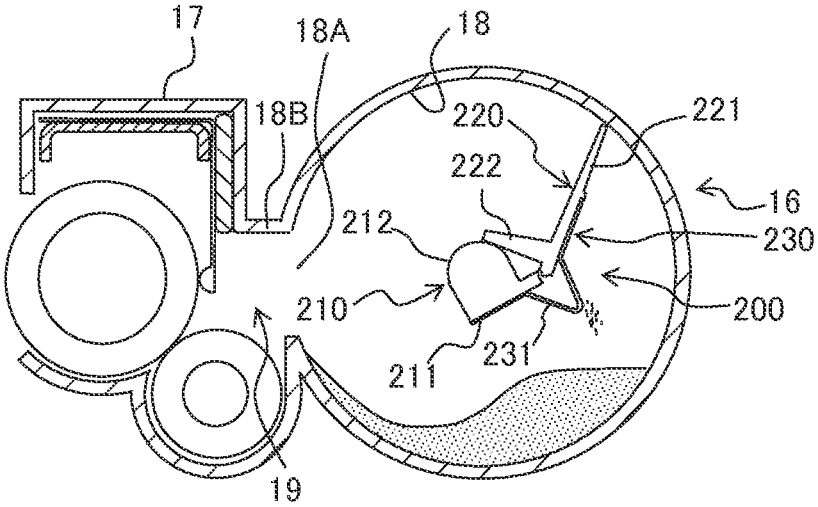

After that, the agitator 200 further continues the rotation, and the forward end portion of the main agitator body 220 makes a contact with the inner surface of the developer accommodating chamber 18 again. Accordingly, the deformable portions 231 of the springs 230 are deformed (see FIG. 9A). When the transport flat surface portion 221 of the main agitator body 220 is directed downwardly (see FIG. 9B), the toner, which remains on the transport flat surface portion 221 of the main agitator body 220, is returned into the developer accommodating chamber 18. In this way, the operation shown in FIGS. 8 and 9 is repeatedly performed.

As described above, the transport force for transporting the toner, which is directed from the main agitator body 220 to the developing chamber 19, can be generated by the springs 230 made of metal. Therefore, even when the rigidity of the main agitator body 220 is high, it is possible to transport the toner to the developing chamber 19.

The embodiments of the present teaching have been explained above. However, the present teaching can be appropriately changed and carried out without being limited to the embodiments described above.

For example, in the first, second, and third embodiments, the sheet-shaped member, which is formed of the resin such as polyethylene terephthalate or the like, is used for the main agitator body 130. However, it is also allowable to use a sheet-shaped member formed of any other material provided that the deflective deformation can be performed.

The first, second, and third embodiments are configured such that the forward end portions of the metal member and the main agitator body 130 are not secured to one another. However, the present teaching is not limited thereto. It is also allowable that the forward end portions are secured to one another. Further, for example, the plate spring and the main agitator body are fixed by means of the double sided tape. However, the present teaching is not limited thereto. It is also allowable to achieve the fixation by using any other fixing member such as an adhesive or the like.

The developing apparatus of each of the embodiments described above is the developing apparatus which has one developer accommodating chamber. However, the present teaching is not limited thereto. It is also allowable that the developing apparatus has a plurality of developer accommodating chambers.

The developing apparatus of each of the embodiments described above is constructed as the casing in which the developing chamber and the developer accommodating chamber are integrated into one unit. However, the present teaching is not limited thereto. It is also allowable that a portion, which includes the developer accommodating chamber, is constructed as a toner cartridge which is provided as a distinct member distinct from the casing.

In each of the embodiments described above, the developing cartridge is exemplified as the developing apparatus of the present teaching by way of example. However, the present teaching is not limited thereto. It is also allowable that a so-called process cartridge, which is provided with a photosensitive drum and a developer carrier, is provided as the developing apparatus.

What is claimed is:

1. A developer transport member for transporting developer in a developer accommodating chamber comprising:

a rotatable member;

a main body configured to transport the developer by being rotated in accordance with rotation of the rotatable member; and a metal spring configured to bias the main body, wherein the main body includes a sheet-shaped member made of resin which is deflectively deformable, a proximal end portion of the sheet-shaped member extends in a radial direction of the rotatable member, wherein a proximal end portion of the metal spring is fixed to the rotatable member, and the metal spring extends in the radial direction, and wherein a length of the metal spring in the radial direction is greater than a distance between the proximal end portion of the metal spring and an inner surface of the developer accommodating chamber in an area below a rotating shaft of the rotatable member.

2. The developer transport member according to claim 1, wherein the metal spring has a plurality of biasing portions for biasing the main body and a connecting portion connecting proximal end portions of the plurality of biasing portions.

3. The developer transport member according to claim 2, wherein the metal spring is comb-shaped.

4. The developer transport member according to claim 1, wherein both of a proximal end portion of the metal spring and a proximal end portion of the main body are fixed to the rotatable member, and forward end portions of the metal spring and a forward end portion of the main body are not secured to one another.

5. The developer transport member according to claim 1, wherein a forward end portion of the metal spring is positioned on a side near to the rotatable member as compared with a forward end portion of the main body.

6. The developer transport member according to claim 1, wherein the metal spring includes a plate spring.

7. The developer transport member according to claim 1, wherein the metal spring includes a wire spring.

8. The developer transport member according to claim 1, wherein the metal spring has a plurality of biasing portions for biasing the main body, and the respective biasing portions are secured to the sheet-shaped member independently from each other respectively.

9. A developing apparatus comprising:

a developer carrier configured to carry developer;

a casing defining a developer accommodating chamber for accommodating the developer and a developing chamber in which the developer carrier is arranged, a developer transport member configured to transport the developer from the developer accommodating chamber to the developing chamber, the developing transport member comprising:

a rotatable member;

a main body configured to transport the developer by being rotated in accordance with rotation of the rotatable member; and a metal spring configured to bias the main body in a direction directed from an upstream side to a downstream side in a rotating direction when the main body is rotated while making a contact with an inner surface of the developer accommodating chamber, wherein the main body includes a sheet-shaped member made of resin which is deflectively deformable, a proximal end portion of the sheet-shaped member is fixed to the rotatable member, and the sheet-shaped member extends in a radial direction of the rotatable member, wherein a proximal end portion of the metal spring is fixed to the rotatable member, and the metal spring extends in the radial direction, and wherein a length of the metal spring in the radial direction is longer than a distance between the proximal end portion of the metal spring and the inner surface of the developer accommodating chamber in an area below a rotating shaft of the rotatable member.

* * * * *